US007624848B2

(12) United States Patent
Fischer

(10) Patent No.: US 7,624,848 B2
(45) Date of Patent: Dec. 1, 2009

(54) EQUIPMENT FOR MOUNTING AN ELEVATOR DRIVE

(75) Inventor: Daniel Fischer, Ollon (CH)

(73) Assignee: Inventio AG, Hergiswil NW (CH)

( * ) Notice: Subject to any disclaimer, the term of this patent is extended or adjusted under 35 U.S.C. 154(b) by 619 days.

(21) Appl. No.: 11/109,267

(22) Filed: Apr. 19, 2005

(65) Prior Publication Data

US 2005/0275161 A1 Dec. 15, 2005

(30) Foreign Application Priority Data

May 7, 2004 (EP) ..... 04405289

(51) Int. Cl.
*B66B 11/08* (2006.01)
*B66B 7/00* (2006.01)
*B66B 9/00* (2006.01)
*B21D 39/03* (2006.01)

(52) U.S. Cl. ..... 187/414; 187/250; 187/254; 52/30; 52/745.2; 29/429

(58) Field of Classification Search ..... 187/251, 187/406, 408, 414, 250, 254; 52/745.2, 30, 52/745.19; 29/281.1, 281.4, 559, 429; 248/662, 248/666, 676; *B66B 19/00, 7/00*
See application file for complete search history.

(56) References Cited

U.S. PATENT DOCUMENTS 2,066,221 A * 12/1936 Payne ..... 182/101
3,759,349 A * 9/1973 Sieffert ..... 52/745.2
4,345,671 A * 8/1982 Tosato et al. ..... 52/745.2
4,757,592 A * 7/1988 Reed ..... 29/429
6,006,865 A * 12/1999 Ammon ..... 187/266
6,397,974 B1 * 6/2002 Adifon et al. ..... 187/254
2002/0066622 A1 6/2002 Pettersson et al.
2005/0150728 A1 * 7/2005 Van Der Meijden et al. 187/411
2007/0256899 A1 * 11/2007 Fanielle et al. ..... 187/408

FOREIGN PATENT DOCUMENTS

JP 2000034072 2/2000
JP 2000226169 8/2000
JP 2003292263 10/2003

* cited by examiner

*Primary Examiner*—John Q. Nguyen
*Assistant Examiner*—Stefan Kruer
(74) *Attorney, Agent, or Firm*—Fraser Clemens Martin & Miller LLC; William J. Clemens

(57) ABSTRACT

A mounting tool arranged at an elevator car raisable and lowerable along guide rails by a hoist in an elevator shaft. The hoist is suspended at a load hook of a shaft ceiling, wherein a support cable is connected with a load eye of a car yoke. The mounting tool includes a pivot support pivotally arranged at an axle of a tool foot supported by the car yoke. A load carrier carrying an elevator drive is provided at a free end of the pivot support. An assembly operative standing on the car yoke operates the hoist and the mounting tool.

13 Claims, 4 Drawing Sheets

EQUIPMENT FOR MOUNTING AN ELEVATOR DRIVE

BACKGROUND OF THE INVENTION

The present invention relates to equipment for mounting an elevator drive, which can be mounted by means of a mounting tool and a hoist closely below a shaft ceiling.

Equipment for mounting an elevator drive in the shaft head region is shown in the Japanese Patent Specification JP 2000034072. The equipment consists of a counterweight frame movable along guide rails, an arm arranged at the counterweight frame and a hoist. The hoist is loaded with the elevator drive at a lower floor and then raised by means of the hoist, which engages at the counterweight frame, until in the shaft head region.

A disadvantage of the known equipment is that the arm occupies a considerable amount of space in the shaft cross-section. Transfer of the elevator drive from the arm to the motor bracket is thereby made difficult.

SUMMARY OF THE INVENTION

Here the equipment according to the present invention will provide a remedy. The invention meets the object of avoiding the disadvantages of the known equipment and creating mounting equipment by means of which an elevator drive can be mounted below the shaft ceiling in simple manner.

The advantages achieved by the present invention are substantially that, for the mounting, the elevator drive can be raised by means of a simple mounting tool to below the shaft ceiling and subsequently mounted on the motor bracket. The mounting tool is simple and economic to produce. A safer and more rapid mounting process can be carried out with the mounting tool. In addition, the existing load hook at the shaft head ceiling can be used. Since the elevator drive during the mounting is always made fast to at least one bracket (mounting tool or motor bracket), safety for the assembly operative is ensured.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
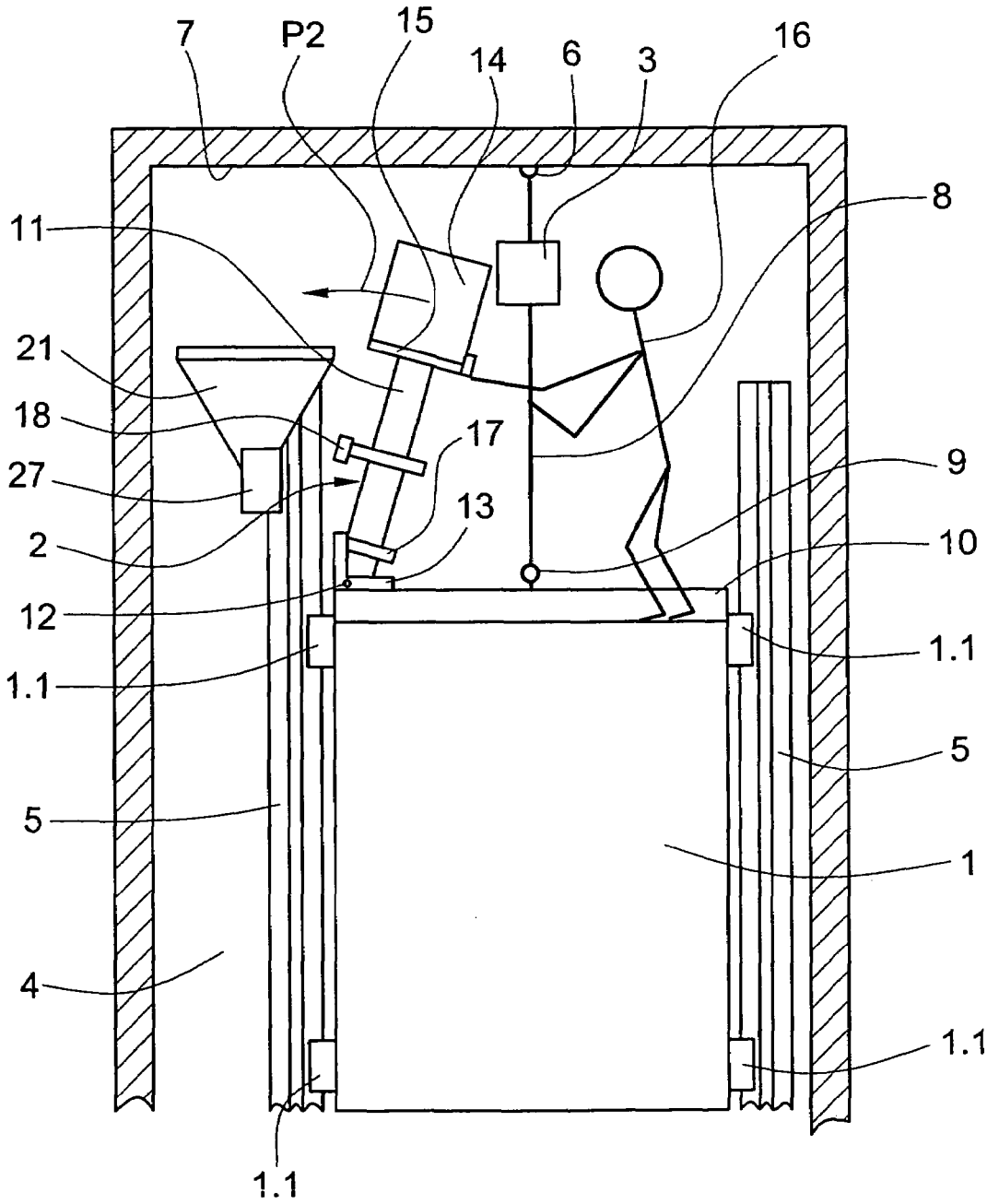
FIG. 1 is a schematic view of a mounting tool according to the present invention arranged at an elevator car.

FIG. 1 shows a mounting tool 2 arranged at an elevator car 1. The elevator car 1 is raisable and lowerable by means of a hoist 3 along guide rails 5 arranged in an elevator shaft 4. The elevator car 1 is guided at the guide rails 5 by means of guide shoes 1.1. The hoist 3 is suspended at a load hook 6 of the shaft ceiling 7, wherein a support means, for example a chain or a belt, is connected with a load eye 9 of a car yoke 10.

The mounting tool 2 consists of a pivot support 11, which is pivotally arranged at an axle 12 of a tool foot 13. The tool foot 13 is supported by the car yoke 10. A load carrier 15 carrying an elevator drive 14 is provided at the free end of the pivot support 11. An assembly operative 16 standing on the car yoke 10 operates the hoist 3 and the mounting tool 2, wherein a first abutment 17 and a second abutment 18 limit the pivot movement of the mounting tool 2.

Figures 2, 3, 4, 5:
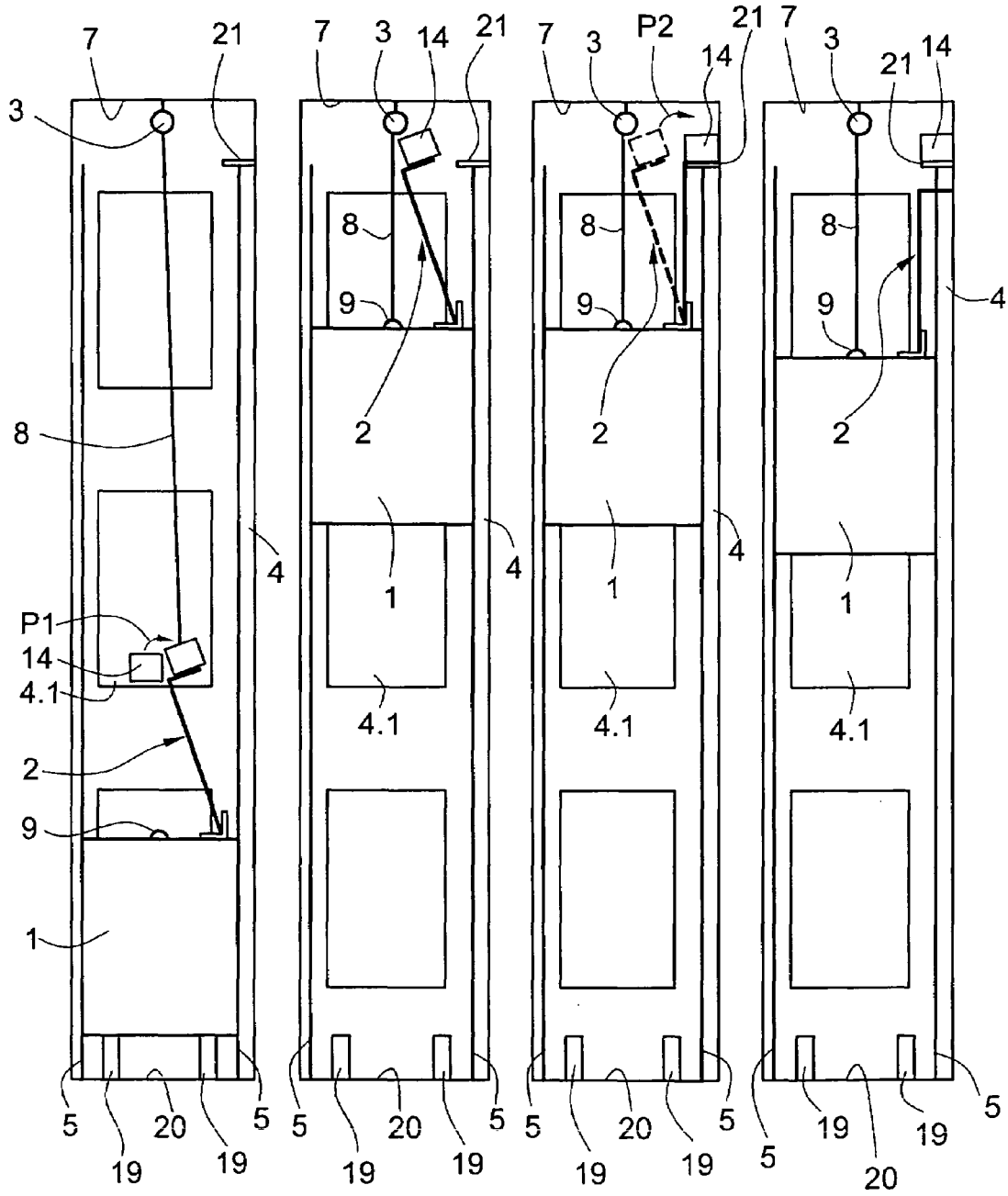
FIGS. 2 to 5 show the mounting of an elevator drive by means of the mounting tool shown in FIG. 1.

FIGS. 2 to 5 show mounting of the elevator drive 14 by means of the elevator car 1 and the mounting tool 2 and the hoist 3. In FIG. 2 the elevator car 1 rests on buffers 19 of a shaft pit 20. The elevator car 1 can also be held in the elevator shaft 4 by means of a safety brake device or by means of clamps or bolts engaging at the guide rails 5 or by means of supports supported in the shaft pit 20. The pivot support 11 of the mounting tool 2 reaches up to the next higher floor 4.1, from which the elevator drive 14 is transferred by means of the hoist 3 to the load carrier 15 of the pivot support 11. The transfer process is symbolically illustrated by means of an arrow P1. After the transfer process the elevator drive 14 is strapped to the load carrier 15 and the support means of the hoist 3 suspended at the load eye 9 of the car yoke 10. According to FIG. 3 the elevator car 1 has been raised by means of the hoist 3 to such an extent that the load carrier 15 is pivotable over a motor bracket denoted by 21. According to FIG. 4 the elevator drive 14 is transferred from the load carrier 15 to the motor bracket 21. The transfer process is symbolically illustrated by means of an arrow P2. According to FIG. 5 the elevator car 1 is lowered after the transfer process to such an extent until the elevator drive 14 rests on the motor bracket 21. Thereafter the elevator drive 14 is firmly screw-connected with the motor bracket 21. The mounting tool 2 enables, together with the hoist 3, mounting of the elevator drive 14 closely (a few centimeters) below the shaft ceiling 7.

Figure 6:
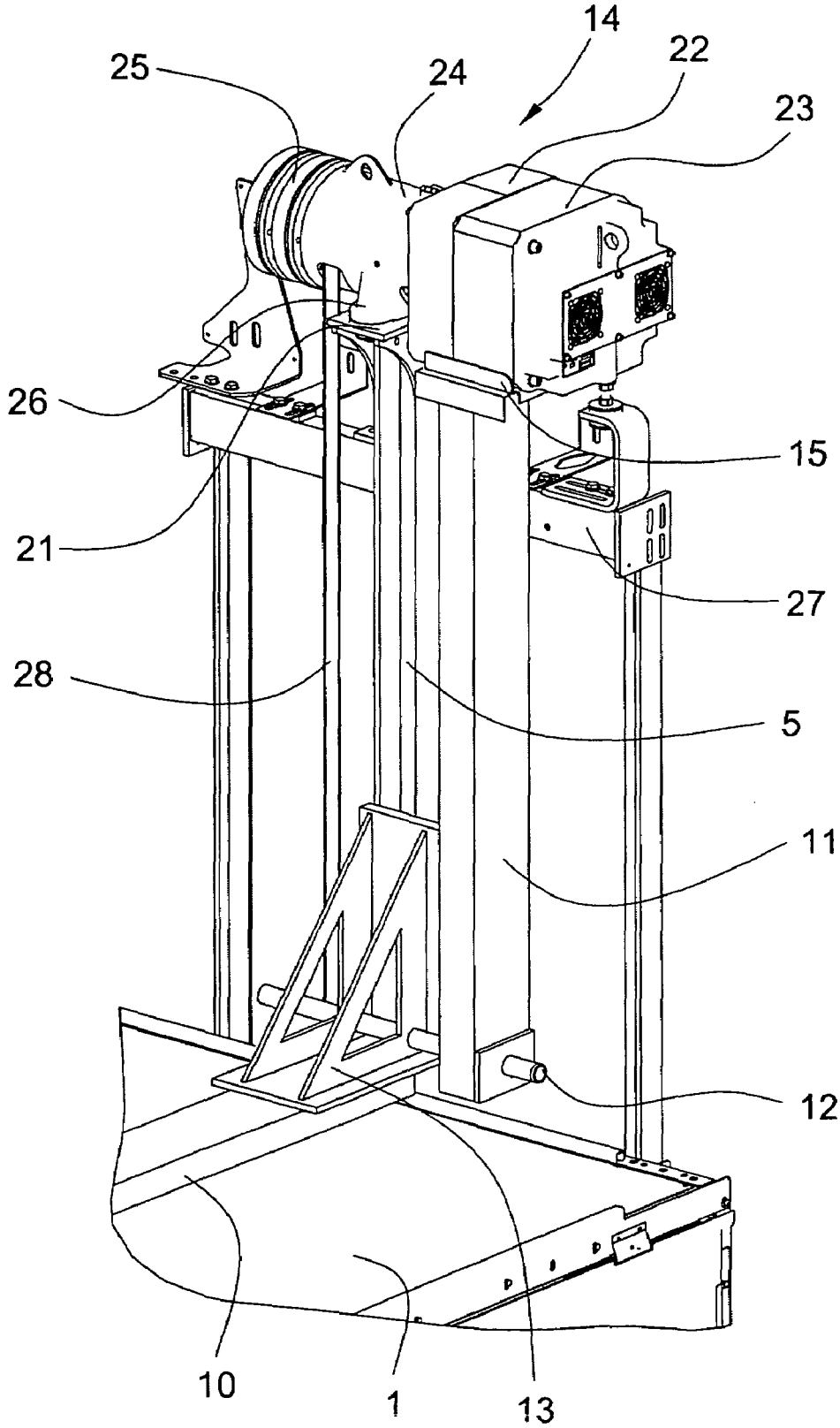
FIG. 6 is a perspective view of the details of the elevator drive and the mounting tool according to the present invention.

FIG. 6 shows details of the elevator drive 14 and the mounting tool 2. The elevator drive 14 consists of a motor 22 with a motor end plate 23, a drive pulley with housing 24 and a brake unit 25 arranged at the drive pulley housing 24. A housing foot 26 of the drive pulley housing 24 is supported on the motor bracket 21, which is supported on a bracket bearer 27 arranged at the guide rails 5. The motor end plate 23 is supported on the bracket bearer 27. A respective opening in the drive pulley housing 24 is provided on each side of the housing foot 26 and a flat belt 28 serving as support and drive means is guided by way of the drive pulley through the openings.

Figure 7:
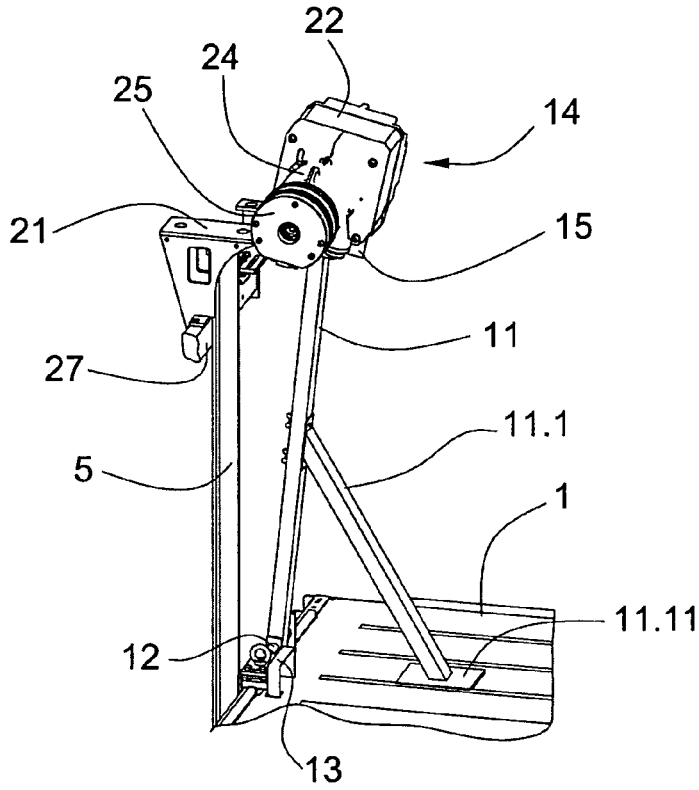
FIGS. 7 and 8 are perspective views of a variant embodiment of the mounting tool according to the present invention.
Figure 8:
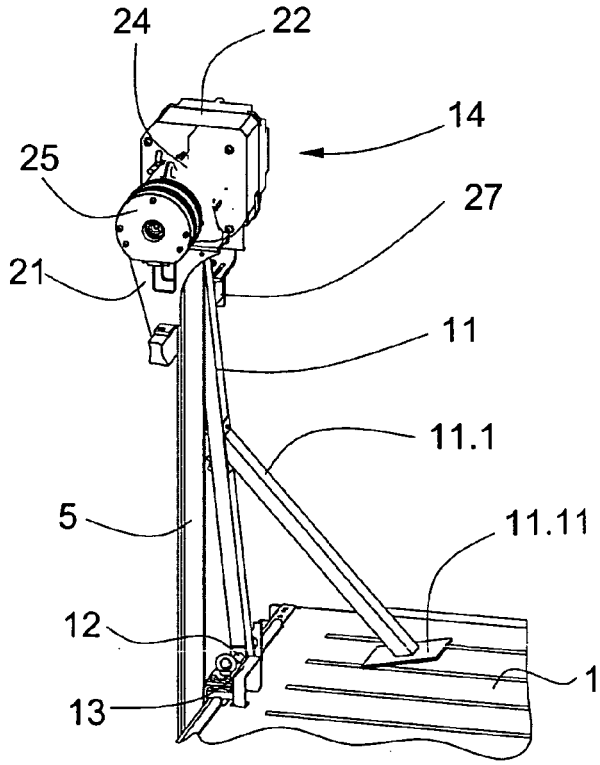

FIGS. 7 and 8 show a variant embodiment of the mounting tool 2. For limitation of the pivot movement the pivot support 11 has, instead of the abutment 17, 18, a support leg 11.1 which as shown in FIG. 7 is supported on the car roof. The support leg foot 11.11 does not load the car roof any more than an engineer standing on the car roof. As shown in FIG. 8, the pivot support 11 is pivoted over the motor bracket 21, wherein the support leg foot 11.11 is raised.

The elevator car 1 is suspended at the corners at support means, wherein the support means are led together below the load carrier 15 over the diagonal intersection point of the car roof and connected with the support means 8 of the hoist 3.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. Equipment for mounting an elevator drive, which drive can be mounted by a hoist closely below a shaft ceiling, comprising:

a mounting tool for supporting the elevator drive and being mounted on a top of an elevator car movable in an elevator shaft with the elevator car being raisable and lowerable by a hoist in the shaft, said mounting tool including a pivot column, the pivot column being pivotally mounted at a lower end of the pivot column to a top of the elevator car for pivoting to and from a vertical position, the pivot column having a load carrier attached at an upper end of the pivot column for carrying the elevator drive on said upper end, the load carrier including a platform on which the elevator drive can sit atop said upper end of said pivot column, whereby when the elevator car is adjacent a motor bracket in the elevator shaft and said mounting tool is pivoted to the vertical position, the load carrier is positioned over the motor bracket.

2. The equipment according to claim 1 wherein said mounting tool includes a tool foot mounted at a car yoke of the elevator car, said pivot column, an axle pivotally attaching said pivot column to said tool foot, and said load carrier mounted substantially perpendicularly to said pivot column for receiving the elevator drive.

3. The equipment according to claim 1 wherein said mounting tool includes said pivot column pivotally mounted at a car yoke of the elevator car for receiving the elevator drive and means for limiting pivotal movement of said pivot column relative to the car yoke.

4. The equipment according to claim 1 wherein said mounting tool is mounted at the car yoke for pivoting said load carrier to position the elevator drive over a motor bracket closely below the shaft ceiling.

5. The equipment according to claim 3 wherein said means for limiting pivotal movement includes a pair of abutments attached to said pivot column.

6. The equipment according to claim 3 wherein said means for limiting pivotal movement includes a support leg having one end attached to said pivot column and a foot attached to an opposite end for contacting the car yoke.

7. Equipment for mounting an elevator drive, which drive can be mounted by a hoist closely below a shaft ceiling, comprising:

a tool foot mounted at a car yoke of an elevator car movable in an elevator shaft, the car yoke disposed at a top of the elevator car;

a pivot column having a lower end pivotally attached to said tool foot; and a load carrier attached to an upper end of said pivot column for receiving the elevator drive on said upper end, the load carrier including a platform on which the elevator drive can sit atop said upper end of said pivot column, whereby when the elevator car is adjacent a motor bracket in the elevator shaft and said tool foot is pivoted to a vertical position, said load carrier is positioned over the motor bracket.

8. The equipment according to claim 7 including means for limiting pivotal movement of said pivot support column relative to said car yoke.

9. The equipment according to claim 7 wherein said pivot column is mounted at the car yoke for pivoting said load carrier to position the elevator drive over a motor bracket closely below the shaft ceiling.

10. The equipment according to claim 8 wherein said means for limiting pivotal movement includes a pair of abutments attached to said pivot column.

11. The equipment according to claim 8 wherein said means for limiting pivotal movement includes a support leg having one end attached to said pivot support column and a foot attached to an opposite end for contacting the car yoke.

12. A method of mounting an elevator drive with a hoist closely below a shaft ceiling, comprising the steps of:

a. positioning an elevator car in an elevator shaft having a hoist;

b. arranging a mounting tool at on a top of the elevator car, said mounting tool including a pivot column, the pivot column being pivotally mounted at a lower end of the pivot column to a top of the elevator car for pivoting to and from a vertical position, the pivot column having a load carrier attached at an upper end of the pivot column for carrying the elevator drive on said upper end, the load carrier including a platform on which the elevator drive can sit atop said upper end of said pivot column;

c. transferring the elevator drive from a next higher floor onto the load carrier on the mounting tool by means of the hoist, wherein the elevator drive sits on the platform atop said upper end of said pivot column;

d. raising the elevator car with the hoist until the elevator drive is adjacent a motor bracket e. pivoting the mounting tool to position the elevator drive over the motor bracket; and f. lowering the elevator car with the hoist until the elevator drive rests on the motor bracket.

13. The method according to claim 12 including performing said step a. by holding the elevator car on buffers in a shaft pit of the elevator shaft.

* * * * *